US006164350A

United States Patent [19]

Olofsson et al.

[11] Patent Number: 6,164,350

[45] Date of Patent: Dec. 26, 2000

[54] METHOD AND DEVICE FOR PREVENTING OR RELEASING A BLOCKING CAUSED BY LOGS FED TO A CHIPPER THROUGH A FEEDING CHUTE

[75] Inventors: Anders Olofsson, Örnsköldsvik; Ulf Perhson, Domsjö, both of Sweden

[73] Assignee: Andritz-Patentverwaltungs-GmbH, Graz, Austria

[21] Appl. No.: 09/403,106

[22] PCT Filed: Apr. 14, 1998

[86] PCT No.: PCT/SE98/00676

§ 371 Date: Oct. 14, 1999

§ 102(e) Date: Oct. 14, 1999

[87] PCT Pub. No.: WO98/46404

PCT Pub. Date: Oct. 22, 1998

[30] Foreign Application Priority Data

Apr. 14, 1997 [SE] Sweden ..... 9701371

[51] Int. Cl.[7] ..... B27C 1/00; B27M 1/00; B27L 11/00

[52] U.S. Cl. ..... 144/329; 144/176; 144/180; 144/373; 241/36; 241/37.5; 209/245

[58] Field of Search ..... 144/162.1, 176, 144/180, 329, 242.1, 364, 373; 241/30, 32, 34, 33, 36, 92, 98, 278.1, 37.5; 209/244, 245

[56] References Cited

U.S. PATENT DOCUMENTS

| | | | |
|---|---|---|---|
| 3,524,485 | 8/1970 | Smith | 144/176 |
| 3,661,192 | 5/1972 | Nicholson et al. | 144/176 |
| 4,088,273 | 5/1978 | Jakobs | 241/35 |
| 4,449,671 | 5/1984 | Martinez-Vera et al. | 241/36 |
| 4,583,574 | 4/1986 | Pallmann | 144/180 |
| 4,690,337 | 9/1987 | Stiefel | 241/36 |
| 5,248,100 | 9/1993 | Arakawa | 241/36 |
| 5,477,900 | 12/1995 | Gray | 144/180 |

FOREIGN PATENT DOCUMENTS 3 238 492 4/1984 Germany .

*Primary Examiner*—W. Donald Bray
*Attorney, Agent, or Firm*—Alix, Yale & Ristas, LLP

[57] ABSTRACT

Method and apparatus for preventing or releasing a blockage occurring in a flow of tree trunks supplied to a wood chipper via a feed hopper and for securing an uninterrupted flow of timber to the chipper. At least one lifting arm is insertable to project through an opening defined in a hopper. The lifting arm is inserted to raise tree trunks wedged in the hopper and release blockages. The duration of the lifting arm insertion is controlled momentarily for limiting the amount of tree trunks supplied to the chipper.

9 Claims, 2 Drawing Sheets

METHOD AND DEVICE FOR PREVENTING OR RELEASING A BLOCKING CAUSED BY LOGS FED TO A CHIPPER THROUGH A FEEDING CHUTE

CROSS-REFERENCE TO RELATED APPLICATION

This is the U.S. National Phase of International Application No. PCT/SE98/00676 filed Apr. 14, 1998.

The present invention relates to procedures and arrangements for preventing or releasing blockage in a feed hopper, caused by the flow of tree trunks supplied through the hopper into a wood chipper, and for securing an uninterrupted flow of timber.

To release said type of blockage/stoppage, known devices have generally required that the production line is stopped for releasing or displacing the tree trunks by lowering any type of lifting means into the hopper.

The object of the present invention is to provide a procedure and arrangements for the operator to release blockage occurring in the feed hopper, or for preventing blockage at an earlier stage.

This object is met according to the invention by providing a procedure, which is characterized by the momentary or controlled insertion of one or several lifting means, projecting from the inner side of the hopper. The lifting arrangement causes at least part of the timber in the feed hopper to be raised and thereby to release the timber which is wedged inside the hopper, or is used momentarily to limit the amount of tree trunks supplied to the hopper.

A remote-controlled lifting means will thereby make the operator able to release blockage occurring in the hopper, or more preferred, to prevent the occurrence of blockage at an earlier stage by the controlled and/or momentary operation of the lifting means, whereby an uninterrupted flow of timber is secured.

The lifting means of the invention comprises one or several lifting arms, operable to be inserted through an opening formed in the inner surface of the hopper. In the inserted position, the free end of each lifting arm projects from the inner surface of the hopper, and in a retracted position the free end of the lifting arm is levelled with, or below, the inner surface of the hopper.

In a preferred embodiment of the invention, the opening for the lifting means is provided in the bottom of the feed hopper. In this embodiment, the raising of the wedged timber is performed simply by a straight upward lifting motion of the lifting means.

In another preferred embodiment of the invention, the lifting means is formed as a curved lever arm. One end of the curved arm is rotatably secured outside of the hopper. In this second embodiment, the lifting means and associated drive means are arranged generally by the side of the hopper, an arrangement which is considered to be mostly preferred in aspect of required mounting space.

In view of a most rapid operation for preventing additional tree trunks to be supplied to the hopper in case of a blockage, the invention provides, in yet another embodiment, an insertable limiting means. Said limiter is provided generally by the side of the feed hopper inlet, and arranged to be insertable in the supply line for stopping the flow of timber, supplied to the feed hopper.

The invention is more clearly disclosed below, reference being made to the attached drawings. In the drawings, FIG. 1 is a diagrammatic view from above, showing a feed hopper and associated wood chipper equipped according to the invention;

Figure 1:
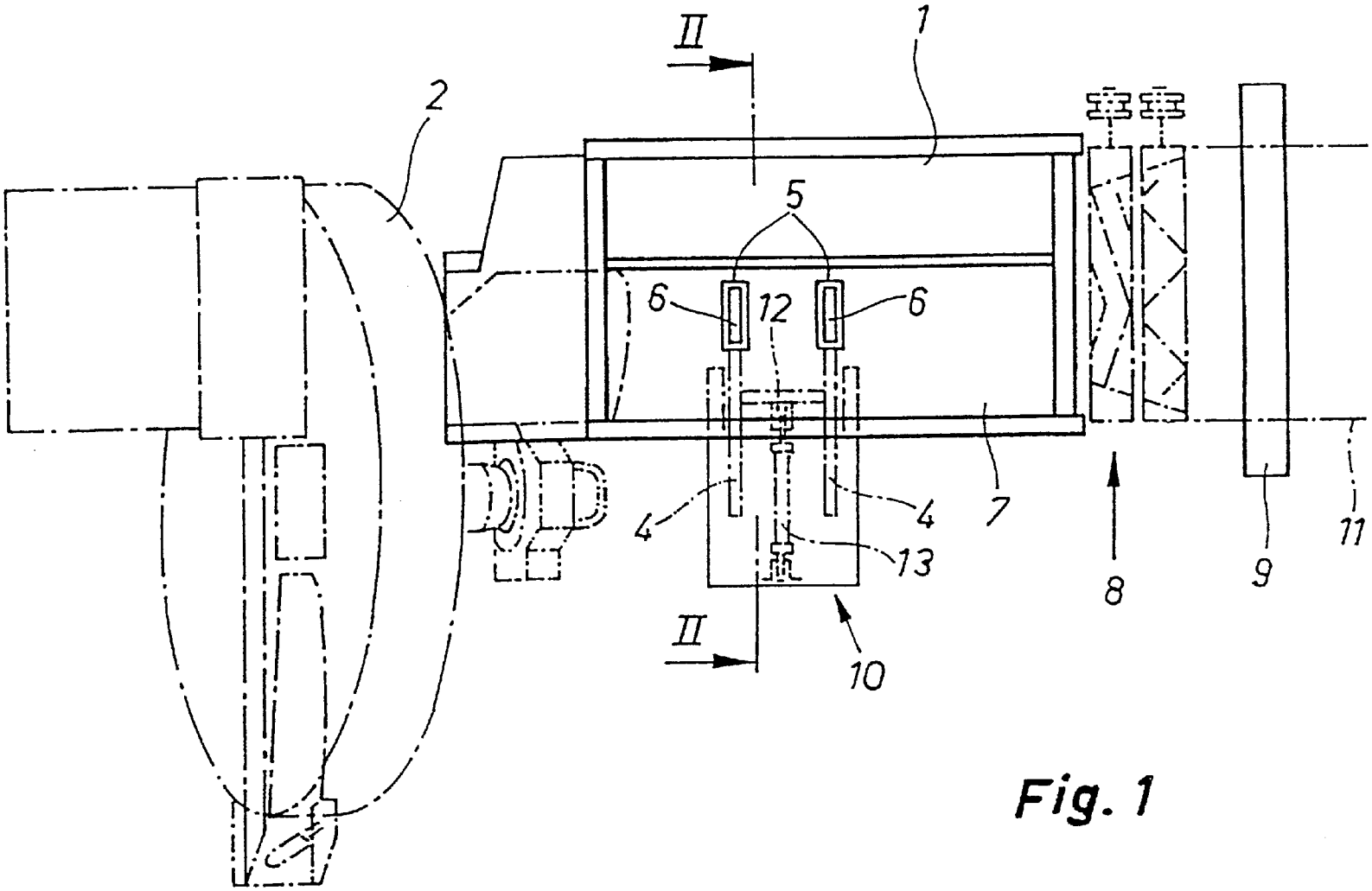

In FIG. 1, the reference number 1 represents a feed hopper for a wood chipper, the tree trunks being supplied to the hopper by a conveyor 11 on the right hand side of the drawing. From the hopper 1, tree trunks are introduced to the cutter or disc chipper 2, on the left hand side of FIG. 1.

Figure 2:
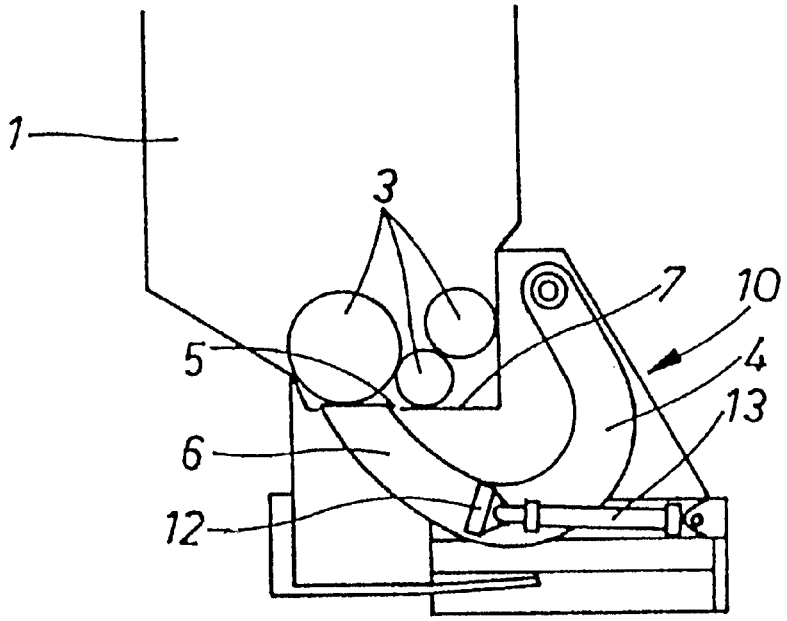
FIG. 2 is a sectional view of line II—II in FIG. 1.
Figure 3:
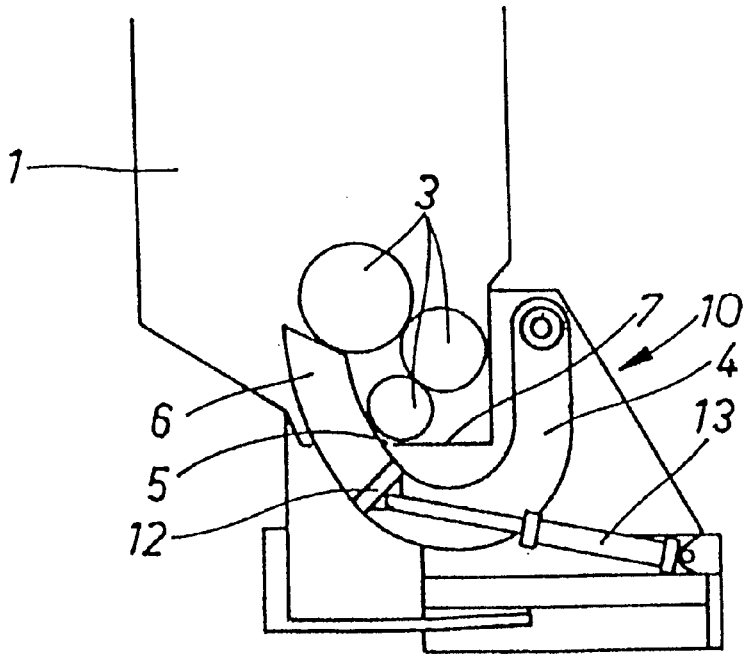
FIG. 3 is a sectional view according to FIG. 2, the lifting means shown in a raised position.

The inventive device, generally referred to as 10, includes one or several lifting means 4. The lifting means 4 are arranged to be insertable through one or several openings 5, formed in the inner face of the hopper 1, on the side or in the bottom 7 of the hopper (as of the drawing, the bottom 7). in the inserted position (see FIG. 3), the lifting means 4 projects with a free end 6 from the hopper inner face, and in a retracted position (see FIG. 2) the free end 6 of the lifting means 4 is levelled with, or below, the inner face of the hopper. Preferably, the free end is levelled with the hopper inner face in the retracted position.

In the embodiment shown in the drawing, the lifting means 4 includes a curved or bowshaped lever arm, one end of which is rotatably secured in a beam or other supporting structure of the hopper, outside of the hopper. Two lifting arms 4 are interconnected by a connection beam 12 to provide a complete lifting arrangement, the raising and lowering of the lifting means being effected by a hydraulic cylinder 13.

One end of the cylinder 13 is connected to the connection beam 12, and the other end is connected to the supporting structure of the feed hopper. It should be apparent, that the lifting means 4 may be differently structured and may e.g. be shaped as a straight rod. Considering a limited building space, the curved or bowshaped configuration is more often the most preferred embodiment.

The lifting means 4 is here shown to be a structural element, controlled by the operator to be projected from the inner face of the hopper 1 as required for releasing wedged tree trunks, or momentarily for limiting the amount of tree trunks supplied to the disc chipper 2.

The embodiment of the inventive assembly 10 as shown in the drawings may additionally include a limiting means 9, arranged by the side of the hopper inlet 8. The limiter 9 is controlled to be inserted above the conveyor, thereby stopping the flow of tree trunks supplied to the feed hopper.

What is claimed is:

1. An apparatus for releasing a blockage occurring in a flow of tree trunks supplied to a wood chipper via a feed hopper, said hopper defining a flow path for said trunks leading to the wood chipper, said apparatus comprising:

at least one bow-shaped lever arm having a free end, said at least one bow shaped lever arm rotatably attached outside of the hopper; and at least one opening in the hopper complementary to said at least one bow shaped lever arm;

wherein said at least one bow-shaped lever arm is projectable to a raised position in which the free end of said at least one bow-shaped lever arm projects through said at least one opening into the flow path to displace tree trunks from a jammed position and retractable to a lowered position in which the free end does not project into the flow path.

2. The apparatus of claim 1, comprising at least two bow-shaped lever arms rotatably attached outside of the hopper and interconnected for simultaneous movement effected by a hydraulic cylinder, said cylinder operatively connected between a support structure of the hopper and a beam connecting the lever arms.

3. The apparatus of claim 1, wherein said hopper comprises a bottom and said at least one opening is defined in said bottom.

4. The apparatus of claim 1, wherein said apparatus comprises:

a conveyor which transports the trunks to the hopper a hopper inlet where trunks pass from the conveyor into the hopper, and limiting means arranged generally adjacent to the hopper inlet, said limiting means movable between a limit position in which the limiting means stops trunks from entering said hopper and a no-limit position in which trunks are permitted to enter said hopper.

5. A method for controlling the flow of tree trunks along a path of flow through a feed hopper to a wood chipper, said method comprising:

providing lifting means movable along an arcuate path within said hopper, said arcuate path generally transverse to said path of flow, said lifting means movable between a retracted position which does not interfere with said path of flow and a projected position which interrupts said path of flow;

moving said lifting means along said arcuate path from said retracted position to said projected position to shift trunks from a jammed position in said path of flow; and controlling the duration that said lifting means is maintained in the projected position to limit the amount of trunks supplied to the chipper.

6. An apparatus for transferring a flow of tree trunks from a conveyor to a wood chipper, said apparatus comprising:

a feed hopper intermediate said conveyor and said chipper. said feed hopper having an interior surface with an aperture defined therein, the interior surface of said feed hopper defining a path of flow for said tree trunks;

at least one U shaped arm having a free end and an opposing end pivotable around an axis located exteriorly to said feed hopper, said arm movable between a retracted position in which said arm is removed from said path of flow and an extended position in which said arm projects into said path of flow, movement of said arm from said retracted position to said extended position displacing at least some of the trunks in said path of flow.

7. The apparatus of claim 6, comprising at least one additional U shaped arm parallel to said U shaped arm, each of said arms interconnected exteriorly of said feed hopper for simultaneous pivotal movement around the same axis, said axis substantially parallel to said path of flow.

8. The apparatus of claim 6, wherein said feed hopper comprises a hopper bottom defining said aperture.

9. The apparatus of claim 6, comprising a support for said feed hopper, said U shaped arm opposing end pivotably mounted to said support.

* * * * *